US012404464B2

(12) United States Patent
Ristic et al.

(10) Patent No.: US 12,404,464 B2
(45) Date of Patent: Sep. 2, 2025

(54) METHOD FOR IMPROVING FEEDSTOCK FLEXIBILITY OF STEAM CRACKING

(71) Applicant: TOTALENERGIES ONETECH BELGIUM, Seneffe (BE)

(72) Inventors: Nenad Ristic, Jette (BE); Laurent Lemineur, Mons (BE); Philippe Laurent, Seneffe (BE)

(73) Assignee: TotalEnergies One Tech Belgium, Seneffe (BE)

( * ) Notice: Subject to any disclaimer, the term of this patent is extended or adjusted under 35 U.S.C. 154(b) by 199 days.

(21) Appl. No.: 18/266,439

(22) PCT Filed: Dec. 8, 2021

(86) PCT No.: PCT/EP2021/084850
§ 371 (c)(1),
(2) Date: Jun. 9, 2023

(87) PCT Pub. No.: WO2022/122850
PCT Pub. Date: Jun. 16, 2022

(65) Prior Publication Data

US 2024/0043759 A1 Feb. 8, 2024

(30) Foreign Application Priority Data

Dec. 10, 2020 (EP) ..... 20213251

(51) Int. Cl.
*C10G 55/04* (2006.01)
*C10G 9/16* (2006.01)

(52) U.S. Cl.
CPC ..... *C10G 55/04* (2013.01); *C10G 9/16* (2013.01); *C10G 2300/1003* (2013.01);
(Continued)

(58) Field of Classification Search
CPC .. C10G 55/04; C10G 9/16; C10G 2300/1003; C10G 2300/1044; C10G 2300/301;
(Continued)

(56) References Cited

U.S. PATENT DOCUMENTS 9,228,140 B2 * 1/2016 Abba ..... C10G 49/007
2012/0130139 A1 * 5/2012 Bridges ..... C10G 9/20 585/648

(Continued)

FOREIGN PATENT DOCUMENTS

DE 20 2015 009 755 U1 2/2020

OTHER PUBLICATIONS

International Search Report for PCT/EP2021/084850 dated Jan. 18, 2022.
Written Opinion for PCT/EP2021/084850 dated Jan. 18, 2022.

*Primary Examiner* — Prem C Singh
*Assistant Examiner* — Juan C Valencia
(74) *Attorney, Agent, or Firm* — Sughrue Mion, PLLC

(57) ABSTRACT

Process for the purification, treatment and steam cracking of a secondary hydrocarbon stream in combination with a primary hydrocarbon stream, wherein the secondary hydrocarbon stream is vaporized before introduction within the convection section of a steam cracker furnace in combination with at least a portion of the said primary hydrocarbon stream.

18 Claims, 1 Drawing Sheet

(52) U.S. Cl.
CPC ..... *C10G 2300/1044* (2013.01); *C10G 2300/301* (2013.01); *C10G 2300/4006* (2013.01); *C10G 2300/802* (2013.01); *C10G 2400/20* (2013.01)

(58) Field of Classification Search
CPC ..... C10G 2300/4006; C10G 2300/802; C10G 2400/20; C10G 9/36
See application file for complete search history.

(56) References Cited

U.S. PATENT DOCUMENTS

| | | | | |
|---|---|---|---|---|
| 2021/0189265 | A1* | 6/2021 | Ding | C10G 69/06 |
| 2022/0235278 | A1* | 7/2022 | Koseoglu | C10G 75/04 |

* cited by examiner

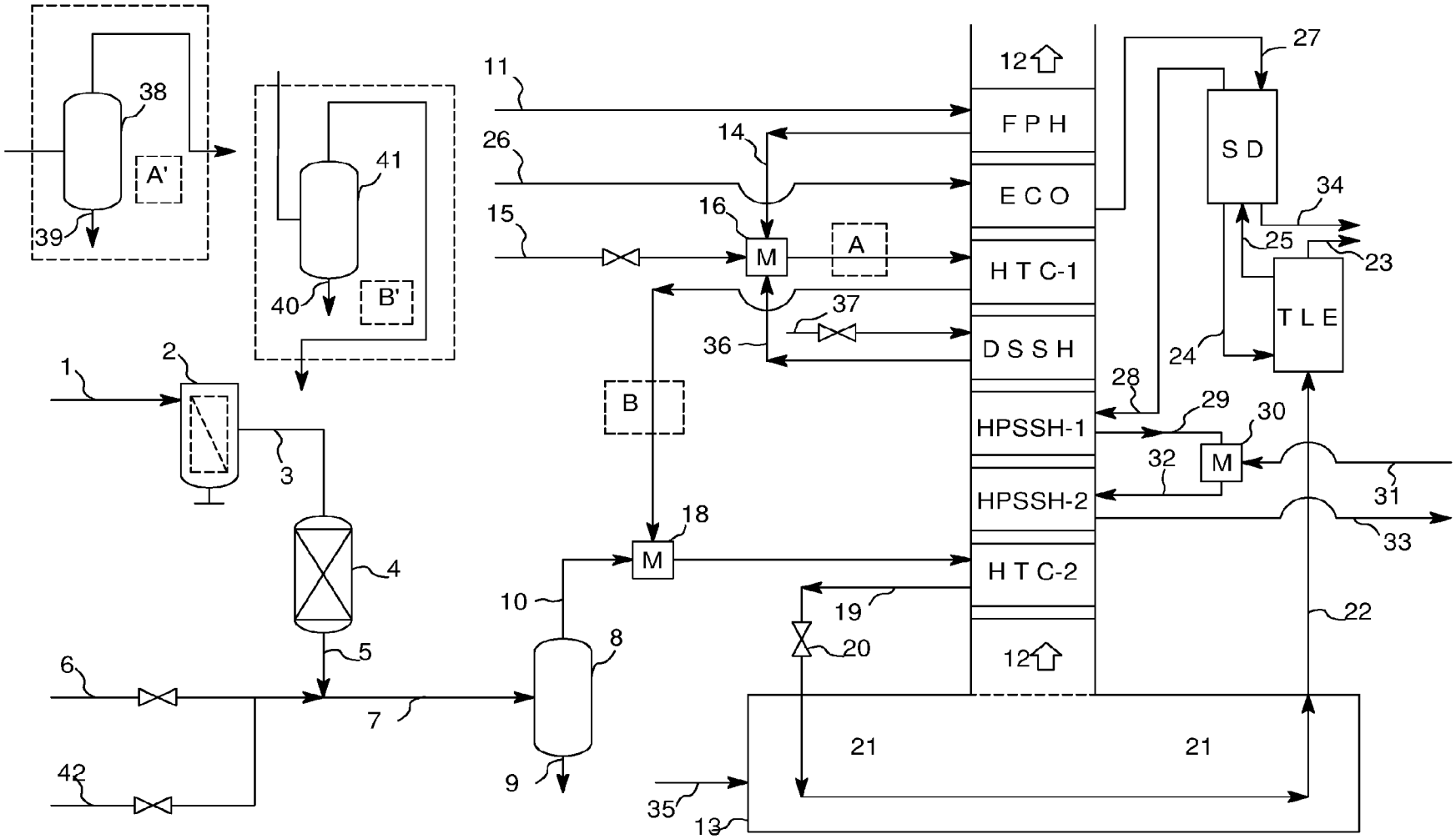
12
F P H
E C O
H T C-1
D S S H
HPSSH-1
HPSSH-2
H T C-2
12
S D
T L E
M
M
M
A
B
A'
B'
21
21
1
2
3
4
5
6
7
8
9
10
11
13
14
15
16
18
19
20
22
23
24
25
26
27
28
29
30
31
32
33
34
35
36
37
38
39
40
41
42

METHOD FOR IMPROVING FEEDSTOCK FLEXIBILITY OF STEAM CRACKING

CROSS-REFERENCE TO RELATED APPLICATIONS

This Application is a National Stage of International Application No. PCT/EP2021/084850 filed Dec. 8, 2021, claiming priority based on European Patent Application No. 20213251.0 filed Dec. 10, 2020, the entire disclosures of which are incorporated by reference herein.

FIELD OF THE INVENTION

The present disclosure relates to a method for improving feedstock flexibility of a steam cracker.

BACKGROUND OF THE INVENTION

Steam crackers are usually designed based on the feedstock to be cracked. Design modification at revamping stage may be challenging since compacity of the unit is high as far as it allows better thermal efficiency and improved product yield.

Rapid changes in unconventional feedstocks use and regulations are in favor of adapting steam crackers to use those materials alone or in combination with conventional feedstock.

Such unconventional feedstocks may encompass optionally hydrotreated plastic pyrolysis oil, hydrotreated biomass pyrolysis oil, optionally hydrotreated vacuum gasoil or a crude oil.

Optionally hydrotreated plastic pyrolysis oil may be obtained by pyrolysis of waste plastic that otherwise could have ended in landfill or incinerator, followed by purification including hydrotreatment and contaminant removal.

Waste plastics are mostly diverted to landfills or are incinerated, with a smaller fraction being diverted to recycling. There is however a strong need, influenced by the regulations to limit waste plastic in landfills. On the other hand, waste plastics disposal into landfills is becoming increasingly difficult. There is therefore a need for recycling waste plastic.

There are four methods of chemical recycling, which are substantially different in terms of waste input and obtained products:

- Depolymerization turns mono-stream plastic (only feasible for condensation-type polymers, such as polyesters (notably PET) and polyamides, through hydrolysis or glycolysis) back into monomers or intermediates, which can be re-polymerized into virgin products.
- Solvent extraction (dissolution) is used to extract certain polymers using solvents without breaking down the polymer. Any dyes, pigments, additives and non-target material are removed by the selective dissolution and the resulting polymer can be reprocessed. Sometimes, it can be used for disassembling multi-layer materials.
- Pyrolysis converts mixed plastics into gas, liquid oil and solid residue char. The liquid can be further refined for fuel or new plastics production.
- Gasification is able to process unsorted, uncleaned plastic waste and turn it into syngas, which can be used to build liquid intermediates (methanol, ethanol, naphtha, diesel . . . ) feedstocks for making base chemicals and as building blocks for new polymers.

These different methods require specific feedstock specification and result in various product qualities. Gasification requires minor pre-treatment, followed by pyrolysis methods (thermal and catalytic cracking), while intensive pretreatment is required in case of depolymerization. The low recycling rate stems from the fact that most of the efforts are focused on mechanical recycling that is only suitable for homogenous and contaminant-free plastic waste, which most of the plastic waste streams are not. Post-consumer waste, end-of-life vehicles, waste from construction and demolition, as well as electrical and electronic equipment waste contain a large portion of plastics that cannot be recycled via mechanical routes.

Chemical recycling through gasification or pyrolysis still have several hurdles. Gasification plants are very capital intensive, require a subsequent syngas conversion unit and need to be built at large scale to benefit from economy of scale, which implies that large waste streams need to be secured to feed the plant (implying logistical costs, risk of fluctuating flowrates and varying compositions of the syngas). Pyrolysis can often be justified at smaller scale while the multiple liquid product streams can be further processed in centralized plants. Even though pyrolysis can handle any type of organic material, including non-organic materials like metals, glass fibers, halogens, additives and often hetero-atomic containing polymers, like PET and PVC, it remains necessary to remove the impurities from the input stream as much as possible, ideally before the process or afterwards through purification of the pyrolysis oil.

Pyrolysis and gasification transform plastics, and most of their additives and contaminants into gaseous chemicals while most of the non-volatile contaminants or additives end up in the solid by-product; chars or ashes. In principle, any kind of plastic waste can be converted, although some pre-sorting of non-organic waste is desired and purification of the output material is necessary as several hetero-elements (i.e. presently referred to as elements different of carbon, hydrogen or oxygen) may be volatilized.

Plastic waste is a complex and heterogeneous material, due to several factors. First, plastic as material refers to numerous different polymers with different chemical properties that need to be separated from each other prior to recycling. The main polymers found in plastic from municipal solid waste are polyethylene terephthalate (PET), polyethylene (PE), polypropylene (PP) and polystyrene (PS). Other polymers essentially include polyurethanes, polyamides (PA), polycarbonates, polyethers and polyesters other than PET. Second, many different additives are introduced during the production phase to adjust or improve the properties of the plastic or to fulfil specific requirements. These include additives such as functional additives (stabilizers, antistatic agents, flame retardants, plasticizers, lubricants, slipping agents, curing agents, foaming agents, biocides, antioxidants etc.), dyes and pigments, fillers (e.g. glass fibers, talcum, carbon fibers, carbon nanotubes), commonly used in plastic packaging as well as additives such as flame retardants, frequently used in plastic for electronics. In addition, several metal compounds are purposely added during plastic production (often as oxides, carbonates, acids, etc.). Beside metals other hetero elements containing additives are used in making plastics, for instance halogens such as bromine in flame retardants, plasticizers, stabilizers etc.

Silicone polymers, which are silicon containing organic materials, are used often in plastic formulations. Thanks to their surface characteristics, applications for silicones range from silicone rubbers, used as sealants for joints, to silicone surfactants for cosmetic products while they are increasingly used in the plastics sector, as process enhancing additives (processing aids), and for the modification of polymers.

On top of these hetero-elements, the used plastic waste can have been contaminated during lifespan by remains of liquids with which they were in contact (beverages, personal-care products, etc.) and of food that can also introduce contamination of the plastic. Last, some plastic waste may be present in the form of partially decomposed waste, such as partly burnt plastic.

Very limited knowledge currently exists about the fate of metals and other hetero element containing additives during plastic pyrolysis which are scarcely analyzed in the liquid products. During pyrolysis, the solid plastics goes through a melting phase, decomposition and volatilization. The vapors are condensed, forming a liquid product and the remaining gases are separated. Some solid residue remains. Hetero-element containing volatiles can end up in the gases (e.g. HCl, $NH_3$ etc.) or in the liquid product (chloro-aromatic, bromo-aromatics, phenols, carboxylic aromatics, alkyl-amines etc.). During pyrolysis at increased temperature, silicones can convert into volatile siloxanes, having boiling points close to naphtha components.

Pyrolysis of plastic waste allows to produce naphtha, ethylene, propylene and aromatics but those products are polluted by many hetero elements originating from the waste plastic itself. Significant concentration of silicon and of organic silicon can be found in the pyrolysis plastic oils. Many prior art processes were focused on the removal of chlorine compounds.

Most of steam crackers in operation are designed for cracking specific feedstocks and their feedstock flexibility is low since improved flexibility always results in increased expenditures at design and construction stage. Below are presented some inventions for improving feedstock flexibility.

US 2005/0261533 describes a method for cracking a hydrocarbon feedstock, wherein the hydrocarbon is heated with a fluid or steam then flashed within a separation vessel, wherein the resulting vapor phase is cracked in the radiant section of a steam cracker.

In EP 1999234 and EP 1999235, the feed is pre-heated in the first stage preheater of a steam cracker, then split in a liquid fraction and a gas fraction in a first separator. The gas fraction is heated separately and mixed with the liquid fraction before the mixture is separated again in a second separator. The resulting gas fraction is sent to cracking while the remaining liquid phase is withdrawn.

U.S. Pat. No. 7,235,705 presents a process design like US 2005/0261533, above, and details a specific gas-liquid separator (5) bearing heating and cooling elements located at different positions to mitigate introduction of coke precursors into the cracking section of a steam cracker.

WO2013/142623 shows an integrated vapor liquid separator using cyclonic means, wherein the separated gas phase is further cracked within the radiant section of a steam cracker.

EP 609191 describes a process for steam cracking, wherein a pre-heated feedstock is separated into a gas fraction and a liquid fraction, the liquid fraction being heated separately then mixed with the gas fraction prior to steam cracking.

U.S. Pat. No. 9,725,657 claims a process for cracking an incompatible feedstock within which asphaltenes precipitate comprising recycling a portion of a liquid phase issued from a vapor-liquid separator back into the said vapor-liquid separator to limit formation and deposition of asphaltenes.

EP 2091638 discloses a method for steam cracking crude oil with a specific gas-liquid separator combining a cyclone and a set of vanes imparting a swirling movement to steam.

None of the above-identified documents disclose a method for concurrent cracking of two different feedstocks within a single steam cracker furnace.

SUMMARY OF THE INVENTION

According to a first aspect, the aim of the present invention is to provide a purified stream originating from e.g. the pyrolysis of plastic wastes which is substantially free of convection section fouling tendency, and to afford a method to thermally decompose the latter in the presence of steam and hydrocarbons.

The invention relates to a process for the purification and treatment of a secondary hydrocarbon stream comprising:

(a). Evaporating the secondary hydrocarbon stream, optionally in the presence of steam, to obtain a secondary gaseous hydrocarbon stream and optionally a secondary residue;

(b). Evaporating a primary hydrocarbon stream in the presence of steam to obtain a primary gaseous hydrocarbon stream and optionally a primary residue;

(c). Combining the secondary gaseous hydrocarbon stream with the primary gaseous hydrocarbon stream optionally in the presence of additional steam, to obtain a combined hydrocarbon and steam mixture;

(d). Thermally cracking the combined hydrocarbon and steam mixture under conditions enabling production of ethylene and propylene;

wherein the secondary hydrocarbon stream has a final boiling point different than the primary hydrocarbon stream, and wherein the primary gaseous hydrocarbon stream and secondary gaseous hydrocarbon stream are both substantially gaseous when they are combined.

Preferably, prior to step (b), the primary hydrocarbon stream is preheated at a temperature comprised from 50 to 300° C. and the secondary gaseous hydrocarbon stream has a final boiling point of at most 650° C., preferably of at most 500° C., more preferably of at most 380° C.

According to a first embodiment, the primary gaseous hydrocarbon stream of step (b) is advantageously heated before combining with the secondary gaseous hydrocarbon at step (c). This heating aims to prevent any hammering effect which could occur when streams at different temperatures are mixed.

According to a second embodiment, the secondary hydrocarbon stream is evaporated in the presence of a high boiling point oil spray or diluent. It has been observed that it resulted in lower equipment fouling and lower side product generation.

The present invention is particularly suitable when the primary hydrocarbon stream does not contain ethane and/or propane as main constituent.

The present invention is particularly suitable when the primary hydrocarbon stream contains a butane, a naphtha, a diesel or a crude oil condensate as main constituent.

The present invention is particularly suitable when the secondary hydrocarbon stream contains an optionally hydrotreated plastic pyrolysis oil, a hydrotreated biomass pyrolysis oil, an optionally hydrotreated vacuum gasoil, a crude oil or a combination of at least two of them.

The present invention is particularly suitable when the secondary hydrocarbon stream contains an optionally hydrotreated plastic pyrolysis oil having a diene value of at least 1 g $I_2$/100 g as measured according to UOP 326, a bromine number of at least 5 g $Br_2$/100 g as measured according to ASTM D1159, wherein the content of the said optionally hydrotreated pyrolysis oil is at least 2 wt %, the remaining part being a diluent such as a hydrocarbon and/or steam.

According to a third embodiment, solids are removed from the secondary hydrocarbon stream prior to evaporation step (a), preferably using filtration means. In some cases, it has been observed that it was advisable to remove solids from the secondary hydrocarbon stream to preserve downstream equipment from fouling and subsequent downtime, especially for steam cracker tubes.

When present, the solids are separated by filtration, sedimentation, centrifugation, flocculation, high boiling oil spray extraction, single or double wall thin film evaporator with or without the use of high boiling point oil diluent or spray, or a combination of at least two of them.

The secondary hydrocarbon stream may contain heteroatoms containing impurities, which heteroatom containing impurities are preferably removed from the secondary hydrocarbon stream prior to evaporation step (a).

Heteroatom containing impurities are preferably removed using an adsorbent or a combination of adsorbents.

According to a further embodiment, the primary hydrocarbon stream is preferably preheated within a heat exchanger located within the convection section of the steam cracker, preferably within a Feed Preheat (FPH) bank, and the combined hydrocarbon and steam mixture is injected within a high temperature convection section, preferably within the first High Temperature Convection bank (HTC-1) or the second High Temperature Convection bank (HTC-2), more preferably within the HTC-2 bank and wherein each of the primary hydrocarbon stream and/or of the secondary hydrocarbon stream can be independently and preferably evaporated using a flash drum, a kettle, a single or double wall thin film evaporator, a falling film evaporator or a combination of at least two of them, prior to introduction in the radiation section of the steam cracker.

The primary residue and/or the secondary residue may be independently mixed with steam cracker pyrolysis fuel oil, fuel oil, bunker fuel, atmospheric distillation residue or vacuum distillation residue, and the resulting mixture may be filtered to remove solids.

According to a second aspect, the present invention relates to a process for decoking of the radiant section and/or of the convection section of a steam cracker running consistently with the process according to the first aspect of the invention, wherein an oxygen containing gas and steam mixture is introduced in lieu of each of (A) the primary hydrocarbon stream, (B) the secondary hydrocarbon stream, (C) the primary gaseous hydrocarbon stream, (D) the secondary gaseous stream, and (E) the combined hydrocarbon and steam mixture, and their combinations, wherein the oxygen containing gas is preferably air and wherein temperature is maintained sufficient to allow combustion of coke layers without impairing metallurgy integrity.

Definitions

The terms "alkane" or "alkanes" as used herein describe acyclic branched or unbranched hydrocarbons having the general formula $C_nH_{2n+2}$, and therefore consisting entirely of hydrogen atoms and saturated carbon atoms; see e.g. IUPAC. Compendium of Chemical Terminology, 2nd ed. (1997). The term "alkanes" accordingly describes unbranched alkanes ("normal-paraffins" or "n-paraffins" or "n-alkanes" or "paraffins") and branched alkanes ("iso-paraffins" or "iso-alkanes") but excludes naphthenes (cycloalkanes). They are sometimes referred to by the symbol "HC-".

The terms "olefin", "olefins", "alkene" or "alkenes" as used herein relate to an unsaturated hydrocarbon compound containing at least one carbon-carbon double bond. They are sometimes referred to by the symbol "HC═".

The terms "alkyne" or "alkynes" as used herein relate to an unsaturated hydrocarbon compound containing at least one carbon-carbon triple bond.

The term "hydrocarbon" or "hydrocarbons" refers to the alkanes (saturated hydrocarbons), cycloalkanes, aromatics and unsaturated hydrocarbons alone or in combination.

As used herein, the terms "$C_{\#}$ alcohols", "$C_{\#}$ alkenes", or "$C_{\#}$ hydrocarbons", wherein "$_{\#}$" is a positive integer, is meant to describe respectively all alcohols, alkenes or hydrocarbons having $_{\#}$ carbon atoms. Moreover, the term "$C_{\#+}$ alcohols", "$C_{\#+}$ alkenes", or "$C_{\#+}$ hydrocarbons", is meant to describe all alcohol molecules, alkene molecules or hydrocarbons molecules having $_{\#}$ or more carbon atoms. Accordingly, the expression "$C_{5+}$ alcohols" is meant to describe a mixture of alcohols having 5 or more carbon atoms.

Weight hourly space velocity (WHSV) is defined as the hourly weight of flow per unit weight of catalyst and liquid hourly space velocity (LHSV) is defined as the hourly volume of flow per unit of volume of catalyst.

The terms "comprising", and "comprises" as used herein are synonymous with "including", "includes" or "containing", "contains", and are inclusive or open-ended and do not exclude additional, non-recited members, elements or method steps.

The recitation of numerical ranges by endpoints includes all integer numbers and, where appropriate, fractions subsumed within that range (e.g. 1 to 5 can include 1; 2; 3; 4 and 5 when referring to, for example, a number of elements, and can also include 1.5; 2; 2.75 and 3.80; when referring to, for example, measurements). The recitation of endpoints also includes the recited endpoint values themselves (e.g. from 1.0 to 5.0 includes both 1.0 and 5.0). Any numerical range recited herein is intended to include all sub-ranges subsumed therein.

The term "conversion" means the mole fraction (i.e., percent) of a reactant converted to a product or products. The term "selectivity" refers to the percent of converted reactant that went to a specified product.

The terms "wt. %", "wt %", "vol. %", "vol %", "mol %" or "mol. %" refer to a weight, volume, or molar percentage of a component, respectively, based on the total weight, the total volume of material, or total moles, that includes the component. In a non-limiting example, 10 grams of component within 100 grams of the material is 10 wt % of components.

The term "barg" is a relative pressure which stands for bar gauge. When a vessel or device has an internal pressure of 1 barg, it corresponds to the pressure of 1 bar relative to atmospheric pressure (or 1 bara). So, if atmospheric pressure is 1 bar, absolute pressure within the vessel is 2 bar or 2 bara. 1 bar is equivalent to 1 barg. Unless otherwise specified, pressures mentioned in the present document are relative pressures.

The term "naphtha" refers to the general definition used in the oil and gas industry. In particular, it refers to a hydrocarbon originating from crude oil distillation having a boiling range from 15 to 250° C. as measured by ASTM D2887. Naphtha contains substantially no olefin as the hydrocarbons originates from crude oil. It is generally considered that a naphtha has carbon number between $C_3$ and $C_{11}$, although the carbon number can reach in some case $C_{15}$. It is also generally admitted that the density of naphtha ranges from 0.65 to 0.77 g/mL.

The term "gas oil" refers to the general definition used in the oil and gas industry. In particular, it refers to a hydrocarbon originating from crude oil distillation having a boiling range from 210 to 360° C. as measured by ASTM D86. Gas oil contains substantially no olefin as the hydrocarbons originates from crude oil. It is generally considered that a gas oil has carbon number between $C_{12}$ and $C_{20}$, although the carbon number can reach in some case $C_{25}$. It is also generally admitted that the density of gas oil ranges from 0.82 to 0.86 g/mL, wherein commercial specification limits density to 0.86 g/mL according to ASTM D1298 (ISO 3675, IP 160).

The term "atmospheric gas oil" or AGO refers to a gas oil having a boiling range from 210° C. to 360° C. as measured by ASTM D86. It is usually a straight run gas oil, i.e. a gas oil which is directly issued from the distillation of crude petroleum.

The term "vacuum gas oil" or VGO refers to a gas oil having a boiling range typically from 260° C. to 580° C. as measured by ASTM D1160, usually obtained by vacuum distillation of atmospheric residue.

The term "fuel oil" refers to a broad class of hydrocarbons having boiling point range higher than gasoline and naphtha, suitable for burning in furnaces or marine engines.

The term "pyrolysis fuel oil" refers either to a fuel oil obtained by pyrolysis of biomass such as wood or straw, or to a fuel oil obtained as the residual fraction from the distillation of the products of a steam cracking process consisting predominantly of unsaturated hydrocarbons having carbon numbers predominantly greater than $C_{14}$ and boiling above approximatively 260° C. (CE number 265-193-8 and CAS number 64742-90-1).

The term "pyrolysis gasoline" here refers to hydrogenated gasoline cut resulting from steam cracking of hydrocarbons boiling in the range of approximatively 20° C. to 200° C. (EC number 302-639-3 and CAS number 941114-03-1).

The term "LPG" refers to the general definition used in the oil and gas industry. In particular, it refers to a hydrocarbon essentially comprised of $C_3$ (propane) with some $C_4$ isomers; n-butane and isobutene.

The term "pyrolysis plastic oil", "plastic pyrolysis oil" or "oil resulting from the pyrolysis of plastic" refers to the liquid products obtained once waste plastic or plastic waste have been thermally pyrolyzed. The pyrolysis process shall be understood as an unselective thermal cracking process. The plastic to be pyrolyzed can be of any type. For instance, the plastic to be pyrolyzed can be polyethylene, polypropylene, polystyrene, polyester, polyamide, polycarbonate, etc. These pyrolysis plastic oils contain paraffins, i-paraffins (iso-paraffins), dienes, alkynes, olefins, naphthenes, and aromatic components. Pyrolysis plastic oil may also contain impurities such as organic chlorides, organic silicon compounds, metals, salts, sulfur, oxygen and nitrogen compounds, etc. The plastic used for generating pyrolysis plastic oil is a waste plastic, irrespective of its origin or nature. The composition of the pyrolysis plastic oil is dependent on the type of plastic that is pyrolyzed. Pyrolysis plastic oil is mainly constituted of hydrocarbons having from 1 to 50 carbon atoms and impurities.

The term "Diene Value" (DV) or "Maleic Anhydride Value" (MAV) corresponds to the amount of maleic anhydride (expressed as equivalents of iodine) which will react with 100 parts of oil under specific conditions. It is a measure of the conjugated double bonds in the oil. One mole of Maleic anhydride corresponds to 1 conjugated double bond. One known method to quantify dienes is the UOP 326: Diene Value by Maleic Anhydride Addition Reaction. The term "diene value" (DV) refers to the analytical method by titration expressed in g of iodine per 100 g of sample. The term Maleic Anhydride value (MAV) refers to the analytical method by titration expressed in mg of Maleic acid per g of sample. There is a correlation between the MAV=DV×3,863 since 2 moles of iodine correspond to 1 mole of Maleic Anhydride.

The term "bromine number" corresponds to the amount of reacted bromine in grams by 100 grams of sample. The number indicates the quantity of olefins in a sample. It is determined in grams of $Br_2$ per 100 grams of sample ($gBr_2$/100 g) and can be measured according to ASTM D1159 method.

The term "bromine index" is the number of milligrams of bromine that react with 100 grams of sample. It is determined in milligrams of $Br_2$ per 100 g of solution (mg $Br_2$/100 g) and can be measured for instance according to the method ASTM D2710.

The term "boiling point" refers to boiling point generally used in the oil and gas industry. Boiling point is measured at atmospheric pressure. The initial boiling point is defined as the temperature value when the first bubble of vapor is formed. The final boiling point is the highest temperature that can be reached during a standard distillation. At this temperature, no more vapor can be driven over into the condensing units. The determination of the initial and final boiling points is known in the art. Depending on the boiling range of the mixture, various standardized methods can be used, such as ASTM D2887 relating to the boiling range distribution of petroleum fractions by gas chromatography. For compositions containing heavier hydrocarbons ASTM D7169 may alternatively be used. Boiling range of distillates is advantageously measured using ASTM D7500, D86 or D1160.

The concentration of metals in the matrix of hydrocarbon can be determined by any method known in the art. Relevant characterization methods include XRF or ICP-AES methods. Those skilled in the art know which method is the most adapted to each metal measurement and to which hydrocarbon matrix.

Features, structures, characteristics or embodiments may be combined in any suitable manner, as would be apparent to a person skilled in the art from this disclosure, in one or more embodiments.

DETAILED DESCRIPTION OF THE FIGURE

The FIGURE shows a simplified overview of a possible process scheme according to the invention. A first hydrocarbon containing feedstock (1) is introduced into a filter unit (2) to produce a filtered stream (3). Filtration aims to remove solids and gums, which may be present when the stream contained unsaturated hydrocarbons at the origin and when storage conditions were not appropriate. For instance, excessive heat, oxygen, lack of antioxidant, traces of catalytic metals may result in gums and/or solids formation. Hydrocarbon containing feedstocks particularly prone to gums and/or solids formation include without limitation plastic pyrolysis oil, vacuum gasoil, diesel and heavier cuts from fluid catalytic cracking, oils from biological origin such as castor oil, linen oil or spent cooking oil. Other means to remove solids and gums may be used, such as centrifugation. Filtered stream (3) is then passed through an adsorbent section (4) to remove contaminants such as oxygen, nitrogen and sulfur containing molecules and metals to provide a secondary hydrocarbon stream (5). Filtration (3) and adsorption (4) are preferably conducted at ambient or near ambient temperature since heating may result in lowered stream chemical stability and lower process performance. Other methods for contaminant removal may be appropriate, including e.g. one or two stage hydrotreatment, flocculation and precipitation. The secondary hydrocarbon stream (5) is then heated using steam (6) optionally in combination with e.g. a heat exchanger (not shown) to produce an at least partially vaporized decontaminated hydrocarbon and steam stream (7). It is desirable that the secondary hydrocarbon (5) is at a temperature which is high enough to avoid condensation of steam when direct mixing is envisioned, since steam condensation could lead to hammering issues. If this is not the case, preheating of (5) in a heat-exchanger is necessary before additional heating with steam is achieved. Non-vaporized products (9) from stream (7) are removed in a separation section (8) to produce a secondary gaseous hydrocarbon stream (10). Alternatively, the secondary hydrocarbon (5) is heated using a hot oil (42), which is collected in admixture with the non-vaporized products (9) and may be recycled.

A primary hydrocarbon stream (11) is heated in a feedstock preheater section (FPH) located in the convection section (12) of a steam cracker furnace (13) to provide a pre-heated hydrocarbon feedstock (14). The pre-heated hydrocarbon feedstock (14) is diluted with stream (15) in a first mixing section M (16) prior to introduction in a first high temperature convection bank (HTC-1) wherein gasification of hydrocarbons produces a primary gaseous hydrocarbon stream (17). Stream (15) may be chosen among steam, the secondary gaseous hydrocarbon stream (10) or a combination of both. In case the secondary gaseous hydrocarbon stream (10) is sent to first mixing box M (16) with or without additional steam, then second mixing box M (18) is not directly connected with the secondary gaseous hydrocarbon stream (10) line (this option is not shown on scheme 1). The first mixing section (17) is also fed with additional steam (36) obtained by heating a steam stream (37) into a dilution steam super heater section (DSSH) located in convection section (12). Primary gaseous hydrocarbon stream (17) is mixed with the secondary gaseous hydrocarbon stream (10) in a second mixing section M (18) prior to introduction in a second high temperature convection bank (HTC-2) wherein the combined stream of (10) and (18) is heated to provide heated stream (19). Heating within HTC-2 bank is shown here as co-current, while it could be considered that counter-current heating would be desirable. Heated stream (19) passes through a nozzle (20) before introduction in the radiant section (21) of steam cracker furnace (13) wherein hydrocarbons contained in heated stream (19) are cracked. Radiant section (21) is heated using fuel gas feeding through line (35) (combustion air inlet not shown). Combustion gases leave radiant section (21) to enter convection section (12) (see, bottom arrow) wherein their heat is used by different heat exchangers, respectively HTC-2, HPSSH-2, HPSSH-1, DSSH, HTC-1, ECO and FPH, before release (see, upper arrow). Resulting cracked gases (22), when leaving furnace (13) are rapidly quenched within a transfer line exchanger (TLE) and directed in line (23) to be processed in a separation section (not shown) wherein olefins of interest, especially ethylene and propylene, are isolated along with other higher molecular weight products such as butadiene and aromatics.

Transfer line exchanger (TLE) allows rapid cooling of cracked gases (22) by means of a heat exchanger (not shown) wherein water is circulated. Water (24) coming from the bottom of a steam drum (SD) is vaporized in the transfer line exchanger (TLE) and sent back to steam drum (SD) through line (25). Additional water (26) is pre-heated within the convection section (12) in an exchanger (ECO), then resulting pre-heated water (27) feds steam drum (SD). Steam drum (SD) is regulated using purge line (34). Vapor from steam drum (SD) is sent through line (28) into a first high pressure steam super heater section (HPSSH-1) wherein steam is super-heated. Resulting super-heated steam (29) is then quenched with water stream (31) in a third mixing section M (30) before introduction in a second high pressure steam super heater section (HPSSH-2) through line (32). Third mixing section M (30) enables thermal regulation of convection section (12) through cooling of stream (29). Last, high pressure steam leaves high pressure steam super heater section (HPSSH-2) through line (33) for further use. Dotted square section (A') corresponds to an alternative design of dotted square section (A), in which heated stream leaving first mixing section M (16) is sent to a separation section (38), wherein non-vaporized compounds (39) are removed to prevent downstream fouling of HTC-1 heat exchanger. Similarly, dotted square section (B') corresponds to an alternative design of dotted square section (B), in which non-vaporized compounds (40) present in stream (17) are removed in a separation section (41) prior to introduction in second mixing section M (18). When used, alternative designs (A') and (B') may be present each independently or in combination. Non-vaporized streams (9), (39) and (40) may be recycled or used for other purposes depending on their composition.

Process air connections (not shown) can be added on any of the feeding lines and on various locations to allow simultaneous on-line decoking of evaporator and furnace. Suitable connections may be located for instance on the primary hydrocarbon stream (11) line, the secondary hydrocarbon stream (6) line, the preheated hydrocarbon feedstock (14) line, the primary gaseous hydrocarbon stream (17) line, the secondary gaseous hydrocarbon stream (10) line, the first mixing section M (16), the second mixing section M (18) and heated stream (19) line, which heated stream (19) being a combined hydrocarbon and steam mixture.

DETAILED DESCRIPTION OF THE INVENTION

The secondary hydrocarbon stream may contain pyrolysis plastic oil up to 100 wt. %. The other component of said secondary hydrocarbon stream in combination with pyrolysis plastic oil may include any diluent acceptable by a steam cracker containing as few olefins and dienes as possible. A naphtha can be used as diluent. The use of naphtha as diluent is particularly advantaging. In a preferred embodiment, the pyrolysis plastic oil is diluted into naphtha having a boiling range from 15 to 250° C., preferably 38 to 150° C., as measured with method ASTM D2887 to form the hydrocarbon stream at a concentration of 50 wt %, preferably 75 wt %, more preferably 90 wt % of pyrolysis plastic oil that is diluted in the naphtha. Alternatively, a middle distillate (boiling range 180-360° C.) may be used as diluent, preferably a jet fuel or a diesel. Paraffinic middle distillate is preferred. Other suitable secondary hydrocarbon streams include spent cooking oil, animal fats and greases, edible or non-edible vegetable oils, which may be advantageously diluted in preferably paraffinic middle distillate. Last, crude oil and especially crude condensates and preferably atmospheric and vacuum distillation products or residues are suitable secondary hydrocarbon streams.

With regards to the waste plastic pyrolysis, an example of a pyrolysis process for waste plastics is disclosed in U.S. Pat. No. 8,895,790 and US20140228606.

With regards to the steam cracker, the primary hydrocarbon feedstock fed to the steam cracker can be ethane or propane if the secondary hydrocarbon feedstock mainly contains a light hydrocarbon such as a naphtha. The primary hydrocarbon feedstock is preferably liquefied petroleum gas, naphtha or gasoil. Liquefied petroleum gas (LPG) consists essentially of propane and butanes. Gasoils have a boiling range from about 200 to 350° C., consisting of $C_{10}$ to $C_{22}$ hydrocarbons, including essentially linear and branched paraffins, cyclic paraffins and aromatics (including mono-, naphtho- and poly-aromatic).

In particular, the cracking products obtained at the outlet of the steam cracker may include ethylene, propylene and benzene, and optionally hydrogen, toluene, xylenes, and 1,3-butadiene.

In a preferred embodiment, the outlet temperature of the steam cracking furnace may range from 750 to 1000° C., preferably from 800 to 950° C., more preferably from 810 to 900° C., more preferably from 820° C. to 880° C. The outlet temperature may influence the content of high value chemicals in the cracking products produced by the present process.

In a preferred embodiment, the residence time in the steam cracker, through the radiation section of the reactor where the temperature is between 650 and 1200° C., may range from 0.02 to 2.0 seconds, preferably from 0.1 to 1.0 seconds.

In a preferred embodiment, steam cracking is done in presence of steam in a ratio of 0.1 to 1.5 kg steam per kg of hydrocarbon feedstock, preferably from 0.25 to 1.0 kg steam per kg of hydrocarbon feedstock in the steam cracker, preferably in a ratio from 0.30 to 0.7 kg steam per kg of feedstock mixture, to obtain cracking products as defined above.

In a preferred embodiment, the steam cracker reactor outlet pressure may range from 500 to 2500 mbarg, preferably from 700 to 1000 mbarg, more preferably may be approx. 850 mbarg. The residence time of the feed in the reactor and the temperature are to be considered together. A lower operating pressure results in easier light olefins formation and reduced coke formation. The lowest pressure possible is accomplished by (i) maintaining the output pressure of the reactor as close as possible to atmospheric pressure at the suction of the cracked gas compressor (ii) reducing the pressure of the hydrocarbons by dilution with steam (which has a substantial influence on slowing down coke formation). The steam/feedstock ratio may be maintained at a level sufficient to limit coke formation.

Effluent from the steam cracker contains unreacted feedstock, desired olefins (mainly ethylene and propylene), hydrogen, methane, a mixture of $C_4$ (primarily isobutylene and butadiene), pyrolysis gasoline (aromatics in the $C_6$ to $C_8$ range), ethane, propane, di-olefins (acetylene, methyl acetylene, 1,2-propadiene), and heavier hydrocarbons that boil in the temperature range of fuel oil (pyrolysis fuel oil). This cracked gas is rapidly quenched to a temperature that may range from 200 to 600° C. to stop the pyrolysis reactions, minimize consecutive reactions and to recover the sensible heat in the gas by generating high-pressure steam in parallel transfer-line heat exchangers (TLE's). In gaseous feedstock-based plants, the TLE-quenched gas stream flows forward to a direct water quench tower, where the gas is cooled further with recirculating cold water. In liquid feedstock-based plants, a prefractionator precedes the water quench tower to condense and separate the fuel oil fraction from the cracked gas. In both types of plants, the major portions of the dilution steam and heavy gasoline in the cracked gas are condensed in the water quench tower at 35-40° C. The gas is subsequently compressed to about 25-35 barg in 4 or 5 stages. Between compression stages, the condensed water and light gasoline are removed, and the cracked gas is washed with a caustic solution or with a regenerative amine solution, followed by a caustic solution, to remove acid gases ($CO_2$, $H_2S$ and $SO_2$). The compressed cracked gas is dried with a desiccant and cooled with propylene and ethylene refrigerants to cryogenic temperatures for the subsequent product fractionation: front-end demethanization, front-end depropanization or front-end deethanization.

EXAMPLES

The embodiments of the present invention will be better understood by looking at the different examples, below.

Example 1: Secondary Hydrocarbon Stream Pretreatment: Solids and Gums Removal Using Cellulose Containing Fibers, Activated Charcoal and Diatomite Followed by Filter Press Separation A pyrolysis plastic oil containing 3 wt % of solid particles having a 10 μm mean particles diameter may be contacted with (i) from 0.1 to 0.5 wt % activated charcoal with specific surface area greater than 50 $m^2/g$, (ii) from 0.1 to 1 wt % of cellulose fibers, and (iii) from 0.1 to 10 wt % of diatomite. Contacting is preferably done during at least 1 minute and up to several days if the mixture is not heated. A stabilizer may be added to the mixture to avoid gums formation or buildup. A suitable stabilizer may be an antioxidant such as 2,6-di-tert-butyl-4-methylphenol (BHT) or derivatives such as Irganox® products (BASF). The amount of stabilizer to be added may be determined by those skilled in the art and may range from 0.001 wt % to 0.1 wt %, depending e.g. on the nature of the pyrolysis plastic oil and treatment conditions. Albeit not mandatory, the resulting mixture may be heated at from 50° C. to 100° C. for 1 to 30 minutes. The mixture can then be filtered through a filter press to produce (i) a solid cake that is discharged and (ii) a solids and gums depleted liquid phase which should contain less chlorine and less metals than pyrolysis plastic oil starting material.

Depending on the contents in impurities, the solids and gums depleted liquid phase may be used as secondary hydrocarbon stream in a steam cracker such as the one described in the present invention, pure or diluted. Depending on the steam cracker technology, the liquid phase may be diluted with e.g. a VGO, a gas oil, diesel, a naphtha, a LPG, butane, propane, ethane or combinations thereof.

Example 2: Steam Cracking of 2.5 t/h Plastic Pyrolysis Oil as Secondary Hydrocarbon Stream in Combination with 9.5 t/h Naphtha as Primary Hydrocarbon Stream A 2.5 t/h vaporized purified plastic pyrolysis oil stream as secondary gaseous hydrocarbon stream (10) with a steam to oil ratio (SOR) of 0.7 kg/kg can be combined with a 9.5 t/h naphtha stream as primary gaseous hydrocarbon stream (17) with a steam to oil ratio (SOR) of 0.7 kg/kg. The plastic pyrolysis oil stream has a final boiling point (FBP) of 420°

C. The combined mixture can be introduced in the HTC-2 section of a steam cracker at a temperature of 377° C. and a pressure of 4.1 barg. The mixture leaves HTC-2 section at 578° C. and 3.7 barg and passes through nozzle (20) wherein pressure drops down to 1.9 barg, then enters radiant section (21) wherein steam cracking occurs. The radiant section contains a radiant box heated with 1562 kg/h of fuel gas at 43° C. burning with 9.1% air excess introduced at 7° C. The low heating value (LHV) of fuel gas is 12368 kcal/kg at 25° C. Fired heat is 19.3 Gcal/h at 25° C., absorbed heat is 8.5 Gcal/h, box efficiency based on fired heat is 44.1%, convection duty is 9.3 Gcal/h, for an overall efficiency of 92.37%.

Naphtha (11) (9.5 t/h, 113° C., 4.8 barg) is first pre-heated in the FPH section to provide stream (14) at 119° C. and 4.7 barg which is then introduced in the first mixing section M (16), combined with 6.65 t/h of dilution steam (36) issued from DSSH section at 474° C. and 4.7 barg and introduced at 204° C. and 4.7 barg in HTC-1 section. Dilution steam (36) from DSSH section results from the feeding of 6.65 t/h steam (37) at 218° C. and 4.8 barg in said DSSH section. Naphtha and steam mixture (17) leaves HTC-1 section at 398° C. and 4.1 barg as primary gaseous hydrocarbon stream (17).

Boiler feed water (26) (14.4 t/h, 116° C., 127 barg) is heated in the ECO section and feeds steam drum (SD) at 226° C. and 126 barg. Steam drum (SD) feeds HPSSH-1 section with steam (14.1 t/h, 327° C., 126 barg) and affords heated steam at 368° C., which is desuperheated with Boiler feed water (0.05 t/h, 116° C., 127 barg) before entering HPSSH-2 section to be superheated at the target temperature. HPSSH-2 section produces high pressure steam at 482° C. and 126 barg. Steam drum purge drain (34) releases approximatively 0.28 t/h.

After leaving the radiant box at 826° C. and 1.6 barg, cracked gases are quenched in TLE section to provide 20.1 t/h of a steam and hydrocarbon combined stream at 364° C. Combustion gases (32081 kg/h) are released from the furnace stack at 144° C.

Decoking may be realized by adding process air connection aside the feeding lines of the hydrocarbons to be purified, such as next to the secondary feedstock vaporizer (evaporator/heat exchanger) to allow simultaneous on-line decoking of evaporator and the furnace. Decoking of vaporizer and furnace reaction coils may be typically achieved with a furnace coil decoking temperature range of 800-1000° C. and a vaporizer decoking temperature range of 300-450° C.

Example 3: Steam Cracking of 2.5 t/h Plastic Pyrolysis Oil as Secondary Hydrocarbon Stream in Combination with 11.5 t/h Naphtha as Primary Hydrocarbon Stream A 2.5 t/h vaporized purified plastic pyrolysis oil stream as secondary gaseous hydrocarbon stream (10) with a steam to oil ratio (SOR) of 0.7 kg/kg can be combined with a 11.5 t/h naphtha stream as primary gaseous hydrocarbon stream (17) with a steam to oil ratio (SOR) of 0.7 kg/kg. The plastic pyrolysis oil stream has a final boiling point (FBP) of 420° C. The combined mixture can be introduced in the HTC-2 section of a steam cracker at a temperature of 394° C. and a pressure of 4.8 barg. The mixture leaves HTC-2 section at 600° C. and 4.4 barg and passes through nozzle (20) wherein pressure drops down to 2.1 barg, then enters radiant section (21) wherein steam cracking occurs. The radiant section contains a radiant box heated with 1865 kg/h of fuel gas at 43° C. burning with 9.1% air excess introduced at 7° C. The low heating value (LHV) of fuel gas is 12368 kcal/kg at 25° C. Fired heat is 23.1 Gcal/h at 25° C., absorbed heat is 9.5 Gcal/h, box efficiency based on fired heat is 41.1%, convection duty is 11.8 Gcal/h, for an overall efficiency of 92.07%.

Naphtha (11) (11.5 t/h, 113° C., 5.7 barg) is first preheated in the FPH section to provide stream (14) at 124° C. and 5.6 barg which is then introduced in the first mixing section M (16), combined with 8.05 t/h of dilution steam (36) issued from DSSH section at 490° C. and 5.6 barg and introduced at 208° C. and 5.6 barg in HTC-1 section. Dilution steam (36) from DSSH section results from the feeding of 8.05 t/h steam (37) at 218° C. and 5.8 barg in said DSSH section. Naphtha and steam mixture (17) leaves HTC-1 section at 413° C. and 4.8 barg as primary gaseous hydrocarbon stream (17).

Boiler feed water (26) (16.1 t/h, 116° C., 127 barg) is heated in the ECO section and feeds steam drum (SD) at 240° C. and 126 barg. Steam drum (SD) feeds HPSSH-1 section with steam (15.8 t/h, 327° C., 126 barg) and affords heated steam at 374° C., which is desuperheated (i.e. cooled down) with boiler feed water (0.54 t/h, 116° C., 127 barg) before entering HPSSH-2 section to be superheated at the target temperature. HPSSH-2 section produces high pressure steam at 482° C. and 126 barg. Steam drum purge drain (34) releases approximatively 0.32 t/h.

After leaving the radiant box at 826° C. and 1.6 barg, cracked gases are quenched in TLE section to provide 23.5 t/h of a steam and hydrocarbon combined stream at 404° C. Combustion gases (38291 kg/h) are released from the furnace stack at 154° C.

Comparative Example 1: Steam Cracking of 2.5 t/h Plastic Pyrolysis Oil and 9.5 t/h Naphtha as Primary Hydrocarbon Stream A mixture of 2.5 t/h of purified plastic pyrolysis oil and 9.5 t/h naphtha stream (90° C., 5.0 barg) can be preheated at 122° C. and 4.9 barg in the FPH section of a steam cracker. The plastic pyrolysis oil stream has a final boiling point (FBP) of 420° C. The combined mixture can then be mixed with dilution steam (8.4 t/h, 458° C., 4.9 barg) then partially vaporized in HTC-1 section (352° C., 4.1 barg) and heated and vaporized in HTC-2 section. The mixture leaves HTC-2 section at 565° C. and 3.7 barg and passes through nozzle (20) wherein pressure drops down to 1.9 barg, then enters radiant section (21) wherein steam cracking occurs. The radiant section contains a radiant box heated with 1635 kg/h of fuel gas at 43° C. burning with 9.1% air excess introduced at 7° C. The low heating value (LHV) of fuel gas is 12368 kcal/kg at 25° C. Fired heat is 20.2 Gcal/h at 25° C., absorbed heat is 8.8 Gcal/h, box efficiency based on fired heat is 43.7%, convection duty is 9.9 Gcal/h, for an overall efficiency of 92.62%.

Boiler feed water (26) (14.1 t/h, 116° C., 127 barg) is heated in the ECO section and feeds steam drum (SD) at 213° C. and 126 barg. Steam drum (SD) feeds HPSSH-1 section with steam (13.8 t/h, 327° C., 126 barg) and affords heated steam at 371° C., which is desuperheated with boiler feed water (0.25 t/h, 116° C., 127 barg) before entering HPSSH-2 section to be superheated at the target temperature. HPSSH-2 section produces high pressure steam at 482° C. and 126 barg. Steam drum purge drain (34) releases approximatively 0.28 t/h. After leaving the radiant box at 827° C. and 1.6 barg, cracked gases are quenched in TLE section to provide 20.4 t/h of a steam and hydrocarbon combined stream at 364° C. Combustion gases (33596 kg/h) are released from the furnace stack at 139° C.

Comparative Example 2: Steam Cracking of 13.1 t/h Naphtha as Sole Hydrocarbon Stream A 13.1 t/h naphtha stream (113° C., 4.7 barg) can be preheated at 118° C. and 4.6 barg in the FPH section of a steam cracker. The combined mixture can then be mixed with dilution steam (6.55 t/h, 491° C., 4.6 barg) then vaporized in HTC-1 section (375° C., 3.9 barg) and heated in HTC-2 section. The mixture leaves HTC-2 section at 591° C. and 3.5 barg and passes through nozzle (20) wherein pressure drops down to 1.9 barg, then enters radiant section (21) wherein steam cracking occurs. The radiant section contains a radiant box heated with 1702 kg/h of fuel gas at 43° C. burning with 9.1% air excess introduced at 7° C. The low heating value (LHV) of fuel gas is 12368 kcal/kg at 25° C. Fired heat is 21.0 Gcal/h at 25° C., absorbed heat is 9.1 Gcal/h, box efficiency based on fired heat is 43.1%, convection duty is 10.4 Gcal/h, for an overall efficiency of 92.47%.

Boiler feed water (26) (14.5 t/h, 116° C., 127 barg) is heated in the ECO section and feeds steam drum (SD) at 223° C. and 126 barg. Steam drum (SD) feeds HPSSH-1 section with steam (14.2 t/h, 327° C., 126 barg) and affords heated steam at 374° C., which is desuperheated with boiler feed water (0.42 t/h, 116° C., 127 barg) before entering HPSSH-2 section to be superheated at the target temperature. HPSSH-2 section produces high pressure steam at 482° C. and 126 barg. Steam drum purge drain (34) releases approximatively 0.28 t/h.

After leaving the radiant box at 827° C. and 1.6 barg, cracked gases are quenched in TLE section to provide 19.6 t/h of a steam and hydrocarbon combined stream at 364° C. Combustion gases (34953 kg/h) are released from the furnace stack at 143° C.

From the examples and comparative examples, it appears that energy efficiency of steam cracking using the process according to the invention is equivalent to conventional steam cracking, while avoiding fouling issues in convection sections, which occur when feedstock is not fully vaporized and/or when containing reactive species such as olefins, diolefins and impurities like some oxygen containing hydrocarbons, e.g. peroxides, epoxides resulting from direct oxidation of olefinic functional groups in e.g. unsaturated fatty acids.

The invention claimed is:

1. A method for the purification and treatment of a secondary hydrocarbon stream comprising:

(a). evaporating the secondary hydrocarbon stream, optionally in the presence of steam, to obtain a secondary gaseous hydrocarbon stream and optionally a secondary residue;

(b). evaporating a primary hydrocarbon stream in the presence of steam to obtain a primary gaseous hydrocarbon stream and optionally a primary residue;

(c). combining the secondary gaseous hydrocarbon stream with the primary gaseous hydrocarbon stream optionally in the presence of additional steam, to obtain a combined hydrocarbon and steam mixture;

(d). thermally cracking the combined hydrocarbon and steam mixture under conditions enabling production of ethylene and propylene;

wherein solids are removed from the secondary hydrocarbon stream prior to evaporation step (a), the secondary hydrocarbon stream has a final boiling point different than the primary hydrocarbon stream, and the primary gaseous hydrocarbon stream and secondary gaseous hydrocarbon stream are both substantially gaseous when they are combined.

2. The method according to claim 1, wherein, prior to step (b), the primary hydrocarbon stream is preheated at a temperature from 50 to 300° C. and the secondary gaseous hydrocarbon stream has a final boiling point of at most 650° C.

3. The method according to claim 2, wherein the primary gaseous hydrocarbon stream of step (b) is heated before combining with the secondary gaseous hydrocarbon at step (c).

4. The method according to claim 1, wherein the secondary hydrocarbon stream is evaporated in the presence of a high boiling oil spray or diluent.

5. The method according to claim 1, wherein the primary hydrocarbon stream does not contain ethane and/or propane as main constituent.

6. The method according to claim 4, wherein the primary hydrocarbon stream contains a butane, a naphtha, a diesel or a crude oil condensate as main constituent.

7. The method according to claim 1, wherein the secondary hydrocarbon stream contains an optionally hydrotreated plastic pyrolysis oil, a hydrotreated biomass pyrolysis oil, an optionally hydrotreated vacuum gasoil, a crude oil, atmospheric or vacuum distillation residues or a combination of at least two of them.

8. The method according to claim 1, wherein the secondary hydrocarbon stream contains an optionally hydrotreated plastic pyrolysis oil having a diene value of at least 1 g $I_2$/100 g as measured according to UOP 326, a bromine number of at least 5 g $Br_2$/100 g as measured according to ASTM D1159, wherein the content of the said optionally hydrotreated pyrolysis oil is at least 2 wt %, the remaining part being a diluent.

9. The method according to claim 1, wherein the solids are removed from the secondary hydrocarbon stream prior to evaporation step (a) using filtration means.

10. The method according to claim 1, wherein the solids are removed by filtration, sedimentation, centrifugation, flocculation, high boiling oil spray extraction, single or double wall thin film evaporator with or without the use of high boiling oil diluent or spray, or a combination of at least two of them.

11. The method according to claim 1, wherein heteroatom containing impurities are removed from the secondary hydrocarbon stream prior to evaporation step (a).

12. The method according to claim 11, wherein the heteroatom containing impurities are removed using an adsorbent or a combination of adsorbents.

13. The method according to claim 1, wherein the primary hydrocarbon stream is preheated within a heat exchanger located within the convection section of the steam cracker, and the combined hydrocarbon and steam mixture is injected within a high temperature convection section, and wherein each of the primary hydrocarbon stream and/or of the secondary hydrocarbon stream is independently and optionally evaporated using a flash drum, a kettle, a single or double wall thin film evaporator, a falling film evaporator or a combination of at least two of them prior to introduction in the radiation section.

14. The method according to claim 13, wherein each of the primary residue and/or the secondary residue is independently blended with steam cracker pyrolysis fuel oil, fuel oil, bunker fuel, atmospheric distillation residue or vacuum distillation residue.

15. A method for decoking of the radiant section and/or of the convection section of a steam cracker running consistently with the method according to claim 1, wherein an oxygen containing gas and steam mixture is introduced in lieu of each of (A) the primary hydrocarbon stream, (B) the secondary hydrocarbon stream, (C) the primary gaseous hydrocarbon stream, (D) the secondary gaseous stream, and (E) the combined hydrocarbon and steam mixture, and their combinations, wherein the oxygen containing gas is air and wherein temperature is maintained sufficient to allow combustion of coke layers without impairing metallurgy integrity.

16. The method according to claim 8, wherein the diluent is a hydrocarbon and/or steam.

17. The method according to claim 13, wherein the convection section of the steam cracker is a FPH bank.

18. The method according to claim 13, wherein the high temperature convection section is a HTC-1 bank or a HTC-2 bank.

* * * * *